US005311010A

United States Patent [19]

Kruger

[11] Patent Number: 5,311,010

[45] Date of Patent: May 10, 1994

[54] BUFFER FOR A GAMMA-INSENSITIVE OPTICAL SENSOR WITH GAS AND A BUFFER ASSEMBLY

[75] Inventor: Hans W. Kruger, Walnut Creek, Calif.

[73] Assignee: The United States of America as represented by the United States Department of Energy, Washington, D.C.

[21] Appl. No.: 11,918

[22] Filed: Feb. 1, 1993

[51] Int. Cl.[5] ..... H01J 40/14

[52] U.S. Cl. ..... 250/214 VT; 313/538

[58] Field of Search ..... 250/214 VT, 214.1, 216; 313/539, 540, 538

[56] References Cited

U.S. PATENT DOCUMENTS 3,961,182 8/1972 Spicer ..... 250/214 VT

*Primary Examiner*—David C. Nelms

*Attorney, Agent, or Firm*—Henry Sartorio; Roger S. Gaither; William R. Moser

[57] ABSTRACT

A buffer assembly for a gamma-insensitive gas avalanche focal plane array operating in the ultra-violet/-visible/infrared energy wavelengths and using a photocathode and an avalanche gas located in a gap between an anode and the photocathode. The buffer assembly functions to eliminate chemical compatibility between the gas composition and the materials of the photocathode. The buffer assembly in the described embodiment is composed of two sections, a first section constructed of glass honeycomb under vacuum and a second section defining a thin barrier film or membrane constructed, for example, of Al and Be, which is attached to and supported by the honeycomb. The honeycomb section, in turn, is supported by and adjacent to the photocathode.

20 Claims, 4 Drawing Sheets

BUFFER FOR A GAMMA-INSENSITIVE OPTICAL SENSOR WITH GAS AND A BUFFER ASSEMBLY

The U.S. Government has rights in this invention pursuant to Contract No. W-7405-ENG-48 between the U.S. Department of Energy and the University of California for the operation of Lawrence Livermore National Laboratory.

RELATED APPLICATION

The invention of this application is an improvement of U.S. application Ser. No. 08/011639 filed Feb. 1, 1993, entitled "Gamma-Insensitive Optical Sensor", and assigned to the same assignee.

BACKGROUND OF THE INVENTION

The invention relates to photon detectors, particularly to ultra-violet, visible, and infra-red photon detection, and more particularly to a buffer assembly for a gamma-insensitive sensor which involves the conversion of incident optical photons into photoelectrons and subsequent amplification of these photoelectrons via generation of electron avalanches.

Photon detectors operate by converting photons into electronic signals that can be processed into pulses or images. These include devices such as photodiodes, photomultiplier tubes, vidicons, charged-coupled devices (CCD's) etc. All photon detectors are characterized by their sensitivity to photons as a function of photon energy, their ability to amplify incident photons into large electrical signals proportional to the incident photon intensity (gain), their ability to distinguish fine detail in an image (position resolution), their temporal response to incident photons (time resolution), and their inherent noise level (dark current).

Various types of photon sensing or detection devices and imaging systems using the detected photons are known in the art as exemplified by U.S. Pat. Nos. 5,032,729 issued Jul. 16, 1991 to G. Charpak; 4,853,395 issued Aug. 1, 1989 to R. R. Alfano et al.; 4,687,921 issued Aug. 18, 1987 to H. Kojola; 4,564,753 issued Jan. 14, 1986 to G. VanAller et al.; and 4,070,578 issued Jan. 24, 1978 to J. G. Timothy et al.

Optical sensors operating in ultraviolet, visible, and infra-red wavelength bands have a variety of applications. The current generation of sensors, such as exemplified above, uses various types of semiconductor focal plane arrays to detect the optical photons emitted, for example, by the combustion of fuel for propulsion, such as a various rockets and/or space vehicles. In certain applications, the optical sensors need to be capable of operating in environments, such as nuclear. One of these environments is the gamma flux emitted by fission or generated by neutron capture in the sensor and nearby materials. Ionizing events caused by these gammas, mainly via Compton, photo and pair-produced electrons, in the thin sensitive layers of the focal plane pixels, will blind the sensor once the gamma flux is sufficiently large so as to produce one or more ionizing events in each and every pixel in the time interval during which the pixels integrate the charges produced by optical photons. For certain applications this blinding gamma flux is on the order of $10^8$ gammas/cm$^2$/sec and higher.

When a single Compton electron traverses the sensitive layer of a semiconductor focal plane array pixel, which is typically 10 microns thick, it will deposit enough energy to produce on the average $10^4$ hole-electron pairs. An optical photon, when absorbed in this same layer, will produce only a single hole-electron pair. It is this $10^4$:1 advantage of a Compton electron relative to an optical photon that enables as little as one gamma event to overwhelm the charge deposited on a pixel from all the optical photons collected in a typical sample time.

While the gamma-insensitive optical sensor of above-referenced application Ser. No. 08/011639 satisfied the prior need for an optical sensor capable of operating in a gamma flux environment, using an avalanche gas in contact with the photocathode, whereby the gammas can be rejected or distinguished from the optical photons, the avalanche gases must be chemically compatible with the photocathode materials. Thus, the sensor of the parent application was limited to choice of avalanche gases due to the chemical compatibility limitation. The present invention provides a solution to this chemical compatibility limitation by providing a buffer between the photocathode and the gas.

SUMMARY OF THE INVENTION

It is an object of this invention to prevent chemical incompatibility between a photocathode and an avalanche gas used in a gamma-insensitive optical sensor.

A further object of this invention is to provide a photocathode buffer for a gamma-insensitive optical sensor.

A further object of the invention is to provide an optical sensor having the capability of distinguishing a gamma event from an optical photon signal which uses avalanche gas and a buffer assembly between the photocathode and the gas.

Another object of the invention is to provide a gamma-insensitive optical sensor using a planar photocathode and a planar anode pad array separated by a narrow gas-filled gap containing a gas and across which is an electric potential and a vacuum buffer assembly between the gas and the photocathode.

Another object of the invention is to provide a gamma-insensitive optical sensor wherein the photocathode and/or the anode is made of monolithic quartz or of quartz scintillating glass, and plastic fibers, and includes a buffer assembly adjacent the photocathode.

Another object of the invention is to provide an optical sensor using a vacuum buffer adjacent the photocathode and wherein the anode is composed of a planar pad array mounted on a plate made of quartz fibers, with the pad array sufficiently thin to be transparent to Cerenkov light, thus increasing the rejection of gamma events.

Other objects and advantages of the present invention will become apparent from the following description and accompanying drawings. Basically, the invention involves an optical (ultra-violet/visible/infra-red) sensor which is insensitive to gamma energy and/or has the capability to discriminate an optical photon signal from a gamma event signal, whereby the sensor can operate effectively in a gamma environment. The sensor consists of a planar photocathode and a planar anode pad array separated by a narrow gap. The gap is filled with an appropriate gas and a voltage is applied across it. A buffer assembly is located between the gas and the photocathode to eliminate chemical incompatibility there between. Electrons ejected from the photocathodes are accelerated sufficiently between collisions with the gas molecules to ionize them, forming an electron avalanche. The gap acts like a planar proportional counter. The anode pads on a front side of an anode plate are connected to matching contact pads on the back of the plate, with connection to signal processing electronics being made from the contact pads. The cathode and the anode plate may be made of monolithic quartz or quartz optical fibers. The anode pads may be thinned so as to be transparent to Cerenkov light such that additional Cerenkov photons reach the photocathode, thus increasing the percentage of gamma events rejected. Also, the quartz fibers may be replaced by scintillating glass or plastic fibers which improve gamma rejection. The buffer may for example comprise a glass honeycomb with a 1,000 Å aluminum or beryllium film in contact with the avalanche gas, thus eliminating chemical incompatibility between the gas and the photocathode, thereby removing limitations on the type of gas that can be used.

BRIEF DESCRIPTION OF THE DRAWINGS

The accompanying drawings, which are incorporated into and form a part of the disclosure, illustrate embodiments of the invention and, together with the description, serve to explain the principles of the invention.

DETAILED DESCRIPTION OF THE INVENTION

The present invention involves a gamma-insensitive optical focal plane array sensor operating in ultra-violet, visible and infra-red wavelength bands and which incorporates a buffer assembly to provide chemical compatibility between the photocathode material and an avalanche gas utilized in the sensor. Since the present invention is an improvement over the gamma-insensitive optical sensor described and claimed in above-referenced application Ser. No. 011,639, and utilizes the components of the sensor of the parent application, FIGS. 1–3 of said parent application and detailed description thereof are set forth hereinafter and prior to a detailed description of the present invention, which constitutes FIGS. 4–6.

The gamma-insensitive optical sensor of said parent application basically comprises a planar photocathode and a planar anode pad array separated by a narrow gap filled with an appropriate gas, with a voltage applied between the anode and the photocathode to produce an electric field within the gap. The photocathode includes a cathode plate which may be constructed, for example, of monolithic quartz or quartz optical fibers. The anode includes an anode plate which also may, for example, be constructed of monolithic quartz or quartz optical fibers, with the anode pad array located on the front side of the anode plate and connected to matching contacted pads on the back side of the anode plate by feed-through wires. The contact pads are connected to signal processing electronics, such as by standard indium bump techniques. Also, the anode pad array may be thinned so as to be transparent to Cerenkov light which results in an increase in the rejections of gamma events. In addition, the quartz fibers of the cathode and anode plates may be replaced by scintillating glass or plastic fiber which provide improved gamma rejection. The buffer assembly may include a glass honeycomb structure having a thin barrier layer or film on one side thereof. Thus, the gamma-insensitive optical sensors of the present invention may be considered as constituting two separate construction arrangements, one using cathode and anode plates constructed of material, such as monolithic quartz, and a second using cathode and anode plates using optical fibers, such as quartz, scintillating glass and plastic fibers, each having certain advantages and disadvantages, as set forth hereinafter, each having a buffer assembly located between the photocathode and the gas in the gap.

Figure 1:
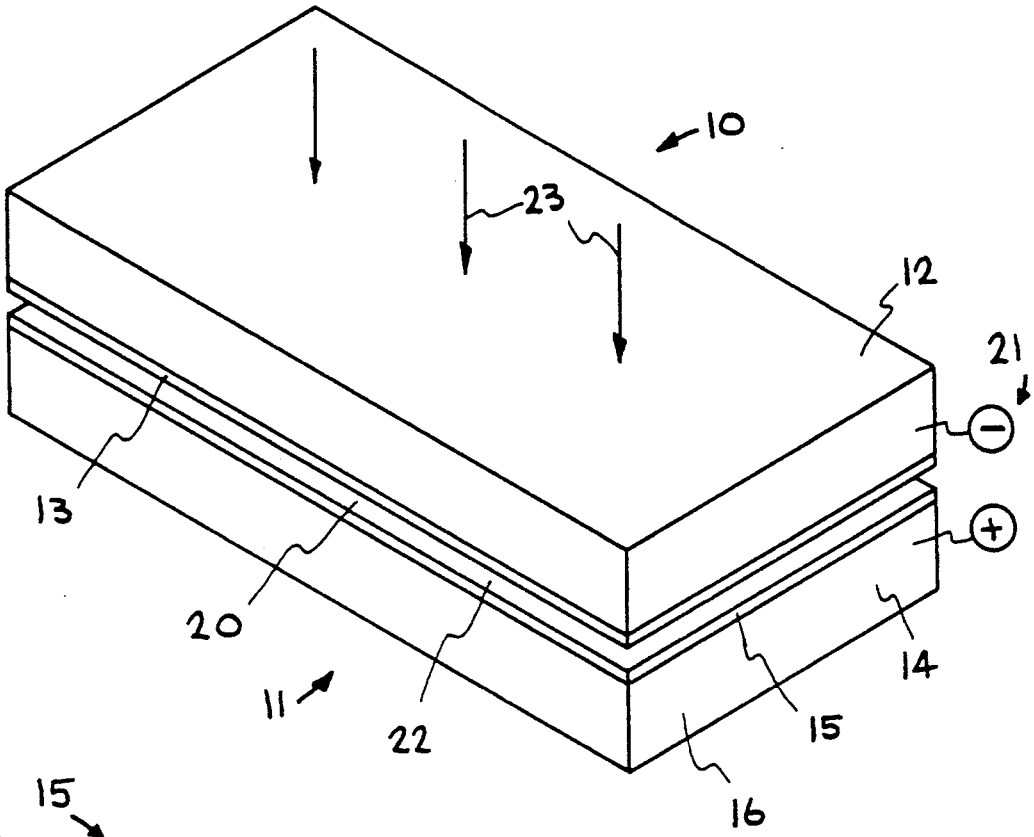
FIGS. 1–3 are views of the gamma-insensitive optical sensor of above-referenced application Ser. No. 08/011639, with FIGS. 2 and 3 illustrating views of the anode array also utilized in the present invention.
Figure 2:
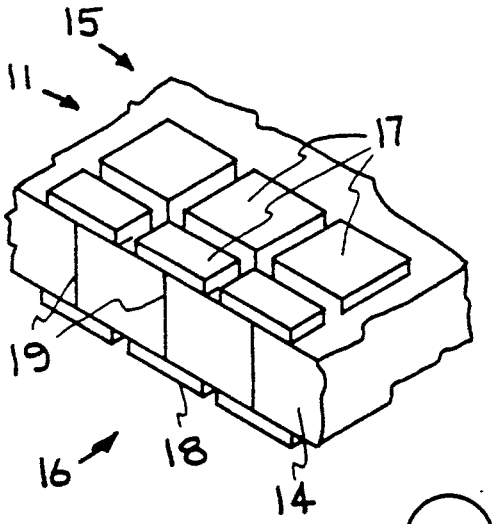
Figure 3:
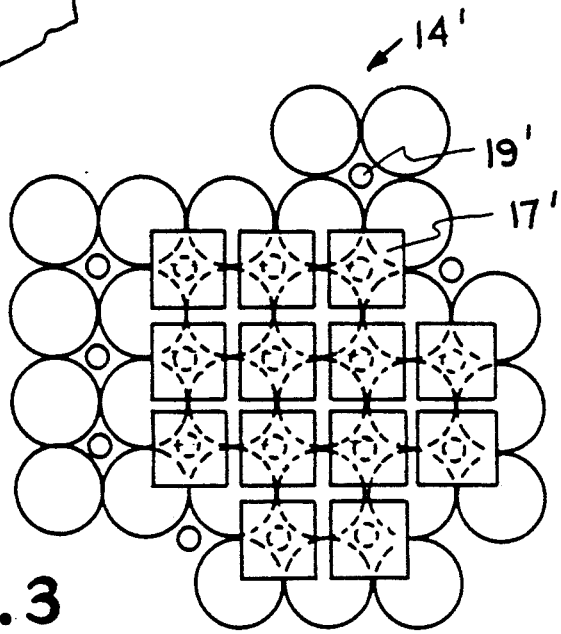

Referring now to the drawings, FIGS. 1–3 illustrate the gamma insensitive optical sensor of application Ser. No. 08/011639 and without the buffer assembly of this invention. FIG. 1 illustrates an embodiment of the optical sensor of the parent application which comprises a cathode generally indicated at 10 and an anode generally indicated at 11. The cathode 10, includes a base or support plate 12 having a layer 13 of material secured thereto and referred to hereinafter and illustrated as a photocathode. The cathode plate 12 is constructed in this embodiment of monolithic quartz, but may be made of any other material transparent at the wavelength of the optical photons to be detected, or constructed of transparent fibers, such as 1 mm (1000 $\mu$) length, 30 $\mu$ diameter quartz fibers. The photocathode 13 is constructed of a thin layer of a semi-transparent material which will convert to photons to be detected into an electron which is ejected into the gap between the photocathode and the anode. The type of material and its thickness are chosen to optimize the efficiency of this conversion process for the photon wavelength to be detected. For ultraviolet, visible, and near-infrared photons the best currently available photocathode materials are those commercially deposited by manufacturers of photomultiplier tubes. The anode 11 is constructed in this embodiment as illustrated in FIGS. 1 and 2 and comprises an anode plate 14 having on one side, referred to herein as the front side, an anode pad matrix or array of a desired pattern generally indicated at 15, and on the opposite side, referred to herein as the back side, a contact pad matrix or array of matching pattern generally indicated at 16, with transparent anode pads 17 of array 15 and reflecting contact pads 18 of array 16 being electrically interconnected by feed-through wires 19, such as 10 $\mu$ diameter wires constructed of invar or any other suitable electric conductive material. The anode plate 14, in this embodiment is constructed of monolithic quartz, but may be constructed of other materials or of fibers as described above with respect to cathode plate 12. By way of example, cathode and anode plates 12 and 14 may have a $12\times12$ mm configuration, the anode pad matrix or array 15 may consist of $300\times300$–28 $\mu\times28$ $\mu$ anode pad 17 constructed of thin (transparent) gold (Au), and the contact pad matrix or array 16 may also consist of $300\times300$–28 $\mu$ contact pads 18 constructed of opaque gold (Au), with indium bumps thereon, not shown, for connection to associated electronics. The anode pads 17 have a thickness of a few microns and the contact pads 18 also have a thickness of a few microns. Thus, the embodiment of FIG. 1 comprises a sensor having a 300×300–28 μ×28 μ pixel pattern, each pixel consisting of an anode pad 17, a contact pad 18, and a feed-through wire 19, with a 4 μ space between pixels. The anode pads 17 are thinned so as to be transparent to Cerenkov light, such that additional Cerenkov photons can reach semi-transparent photocathode 13, whereby the percentage of gamma events rejected on the basis of the pixel pattern can be as large as about 50%.

The cathode 10 is spaced from anode 11 to form a gap or region 20 having a width of 100 μ, for example, with a power supply generally indicated at 21 connected to the cathode and the anode to produce an electric field gap 20. By way of example the power supply 21 may utilize a voltage of about 600 V so as to produce a charge amplification of about $10^6$ for a methane ($CH_4$) gas indicated at 22 and maintained in gap 20 at a pressure of about 150 torr. The charge amplification can be varied by varying both the voltage and pressure. If the gas is increased by a factor of, say, ten then the gas pressure need be reduced by the same factor. In addition, the gas 22 may be an argon (Ar)/methane ($CH_4$) mixture (90% Ar/10% CH4) or other gases or gas mixtures such as xenon, helium, or air may be suitable.

When optical (ultra-violet/visible/infra-red) photons, indicated by arrows 23 in FIG. 1 are incident on the cathode 10 electrons ejected from the photocathode 13 are accelerated sufficiently between collisions with the molecules of gas 22 in gap 20 due to the electric field therein to ionize the molecules, forming electron avalanches which is collected by the pads 17 of anode 11. The charge pulses thus collected on anode pads 17 pass via feed-through wires 19 to contact pads 18 and to appropriate signal electronics. Spatial resolution is inherently limited by the diameter of the head of the avalanche when it arrives at an anode 17 of the anode pad array 15, and it has been experimentally established that for a 100 micron gap 20, the diameter of the avalanche head when it arrives at the anode pad 17 will be about 10 microns.

FIG. 3 illustrates in partial cross-section an embodiment of the anode 10 of FIG. 1 and is generally indicated at 10' wherein the anode plate 14 of FIG. 1 is composed of a plurality of quartz fibers 27 with feed-through wires 19' extending between fibers 27 for connecting anode pads 17' to contact pads such as pads 18 in FIG. 1, but not shown in FIG. 3. The quartz fibers may be replaced by scintillating glass or plastic fibers. Also, the cathode plate 17 of the FIG. 1 embodiment may be constructed of fibers, such that both the cathode plate and the anode plate are constructed of quartz fibers, for example, having a length of 1000μ and width of 30μ.

When extremely low levels of optical photon fluxes are to be detected, the effect of gamma noise is significant for gamma fluxes above $10^{10}$ gammas/$cm^2$/sec. For this reason a means is needed by which gamma counts can be distinguished on the basis of some signature from optical signal counts, and these rejected. This, like the optical sensor of the parent application, is accomplished by the sensor of this invention.

One distinguishing signature of gamma events is that they produce several Cerenkov photons (in addition to perhaps one scintillation photon and one secondary electron). These Cerenkov photons are produced along the track of the Compton electron until its energy falls below the Cerenkov threshold. The range of the electron can extend over dimensions which are many pixels diameters. If the cathode plate 12 is made of monolithic quartz, as in the FIG. 1 embodiment, then these photons will spread over the entire focal plane array (FPA). If the cathode plate 12' is made of quartz optical fibers the photons will be trapped within the fiber in which they are produced. In either case, a gamma event would be characterized by several pixels simultaneously registering a count, whereas an optical signal (or background) photon would only produce a count in one pixel. The Cerenkov pixel counts would occur in a cluster of pixels in a fiber optic cathode plate or distributed over the FPA in a monolithic cathode plate.

Since one avalanche from one optical photon, having a head diameter of 10μ can hit as many as four (4) adjacent pixels (due to the pixels being spaced 4μ apart), a gamma event signature would be simultaneous counts in more than a cluster of four (4) pixels. Considering that a large fraction of the Comptons are produced with an energy too low to produce any or a sufficient number of Cerenkov photons, it is unlikely that more than a quarter of the gamma events could be identified by the pixel count pattern. However, if the anode plate 14' is also made out of quartz fibers, as shown in FIG. 3, and the anode pads 18—18' sufficiently thinned to be transparent to Cerenkov light, the additional Cerenkov photons would pass through the anode pads 18' and reach the photocathode 13' and produce electron avalanches. Under this condition the percentage of gamma events rejected on the basis of the pixel pattern could be as large as about 50%.

If the quartz fibers of the anode and cathode plates 12' and 14' are replaced by scintillating glass composed or scintillating plastic fibers then two (2) effects occur which greatly improve gamma rejection: 1) Compton electrons of all energies can produce photons in them, and 2) The number of optical photons produced increases by two orders-of-magnitude. The average number of photons detected per pixel is now larger than ten, except for the very small percentage of Comptons born with energies below a few keV. A gamma event can now be identified on the basis of its pixel pattern and its order-of-magnitude larger amplitude compared to an optical photon event. Most gammas can now be rejected.

Glass scintillation fibers of various types have been produced commercially with absolute optical photon production efficiencies as high as about 4%. Fiber-optic plates have been produced from 25μ diameter cladded glass scintillation fibers. Plastic scintillation efficiencies are a little higher than those of glass scintillators.

The optical sensor can be designed using cathode plates made of monolithic or fiber optic quartz, or scintillating glass or plastic fibers. The anode plate can also be made of these materials or of a material opaque to optical photons. The simplest design is that of the FIG. 1 embodiment using a monolithic quartz cathode plate 12 and an opaque anode plate 14. Replacing the monolithic quartz with a fiber optic quartz cathode plate doubles the gamma flux capability, while decreasing the gamma discrimination capability somewhat (fewer pixels producing a count).

Use of glass scintillating fibers reduces the gamma flux capability because the scintillation photons are emitted over about 100 nanoseconds (ns), but the gamma rejection is improved.

Plastic fibers have a much shorter scintillation time constant; however, they make the mechanical design more difficult than for glass fibers. The reason is that it is more difficult to hold the required mechanical tolerances with plastic and to deposit the photocathode 13' and the anode pads 17' on such a material compared to glass. The plastic fiber's thickness could be increased to 0.25 cm without increasing the gamma detection efficiency, since density is only about 1 g/cm$^3$. Cerenkov production would increase about a factor of two since it is proportional to the electron's path length.

Another penalty of the scintillating fibers (glass and plastic) is that they will absorb the UV photons and re-emit them in the visible region. Since the re-emission is isotropic, half of the photons will be lost.

The maximum count rate for the quartz plates is limited by the time resolution of the electronics associated with the optical sensor. The fast electronics, such as used in high-energy nuclear physics experiments are capable of nanosecond time resolution. The gas electron collection times will not be limiting if a 100 micron gap 20 is used (about 0.1 ns for $CH_4$, about 1 ns for $Ar/CH_4$). For scintillating fiber optic plates, the scintillation decay time will determine the maximum rate at which gamma pulses can be counted. For glass scintillators the time of decay from 90% to 10% of peak amplitude is about 100 ns. For some commercially produced fast plastic scintillators this decay time is about 2 ns. However, when wanting to count optical photons in the presence of a large gamma count background, the tail of the scintillation decay will impose additional restrictions on the usable gamma count rate, since photons emitted in the tail will appear to be incident optical photons. This can be overcome by lengthening the response time of the associated amplifier so that it will integrate all avalanches produced by a gamma, including those from photons emitted late in the scintillation tail. A quenching agent, such as benzyophenone, can be added to plastic scintillators, to decrease the scintillation tails; but at a loss in scintillation efficiency. An addition of 0.5% benzyophenone reduces this efficiency by a factor of three, and the addition of 2% by an order-of-magnitude.

The maximum gamma count capability corresponds to each pixel of the sensor being busy 100% of the time counting gammas. Under this condition all optical signal counts would be lost. The usable gamma flux capability is determined by the percentage of optical signal loss that is tolerable. The usable gamma flux capability for 10% optical signal loss ranges from $2\times10^{10}$ to $2\times10^{12}$ gammas/cm$^2$/sec among the design variants of the sensor.

For all design variants of the optical sensor, a methane is a better choice for the counting gas 22 in gap 20 than argon/methane, since it has a higher electron drift velocity, although this will not be needed for the scintillating fiber embodiments of the sensor.

Optical gas avalanche focal plane arrays using a quartz cathode plate are feasible with inherent gamma flux capability in the range of $10^{12}$ to $10^{13}$ gammas/cm$^2$/sec. This sensor will register a gamma or an optical photon as a single event with similar charge amplitude. This amplitude is adjustable and can be as large as $10^6$ charges. This sensor offers some gamma event rejection capability by use of the pixel count pattern; but at least 50% of the gamma counts can be expected to be rejected by this signature.

If a large fraction of the gamma need to be rejected, in order to decrease the contribution of gammas to the noise, gas avalanche focal plane arrays can be built using scintillating fiber optic cathode and anode plates, which produce a pulse amplitude for gammas which is an order of magnitude larger than for optical photons. Using this as a discriminant, most of the gammas can be rejected. For glass scintillating fibers, the gamma flux capability ranges from about $10^{10}$ to about $10^{11}$ gammas/cm$^2$/sec. If plastic scintillating fibers are used, the gamma flux capability will increase to about $10^{12}$ to about $10^{13}$ gammas/cm$^2$/sec.

These values of gamma flux capability correspond to 10% signal count loss due to the sensor being busy counting gammas. The order of magnitude uncertainty in capability is due to uncertainties in scintillation decay and associated electronics time resolution achievable within system constraints.

The embodiments of the optical sensor use standard semitransparent photocathodes of the photomultiplier industry. These offer about 10–20% quantum efficiency is the ultra-violet visible wavelength band (about 120–700 nanometers) and about 0.1–0.3% in the infrared wavelength band (about 700–1000 nanometers). The inherent noise or dark current of these photocathodes is sufficiently low so that they can operate at room temperature.

It is thus seen that the sensor utilizes two types of optical focal plane arrays using semi-transparent photocathodes and gas avalanche multiplication to count an optical photon or a gamma event as submicrosecond pulses with a charge that can be adjusted to be as large as $10^6$ electrons. Avalanche head diameters are sufficiently small to allow use of pixel sizes of tens of microns. The first of the above-referenced two types of optical focal plane arrays uses a quartz cathode plate and is of relatively simple mechanical design, which detects a gamma mainly through the Cerenkov photons radiated in the quartz by the high-energy end of the gamma-produced Compton electron spectrum, and can operate in a high gamma flux (about $10^{12}$–$10^{13}$ gammas/cm$^2$/sec.), but has little capability to discriminate between optical photon and gamma counts. The second of the two types of optical focal plane arrays uses scintillating fiber optic cathode and anode plates to detect all the gamma-produced electrons, and is a more complicated design, but it is inherently capable of discriminating between optical photons and gamma events on the basis of pulse height and pixel count pattern, and can operate in a gamma flux of $10^{10}$ to $10^{11}$ gammas/cm$^2$/sec. if built with scintillating glass fibers, and use of plastic scintillation fibers increases the tolerable gamma flux to $10^{12}$–$10^{13}$ gammas/cm$^2$/sec., but use of plastic scintillation fibers makes the mechanical design more difficult.

Figure 4:
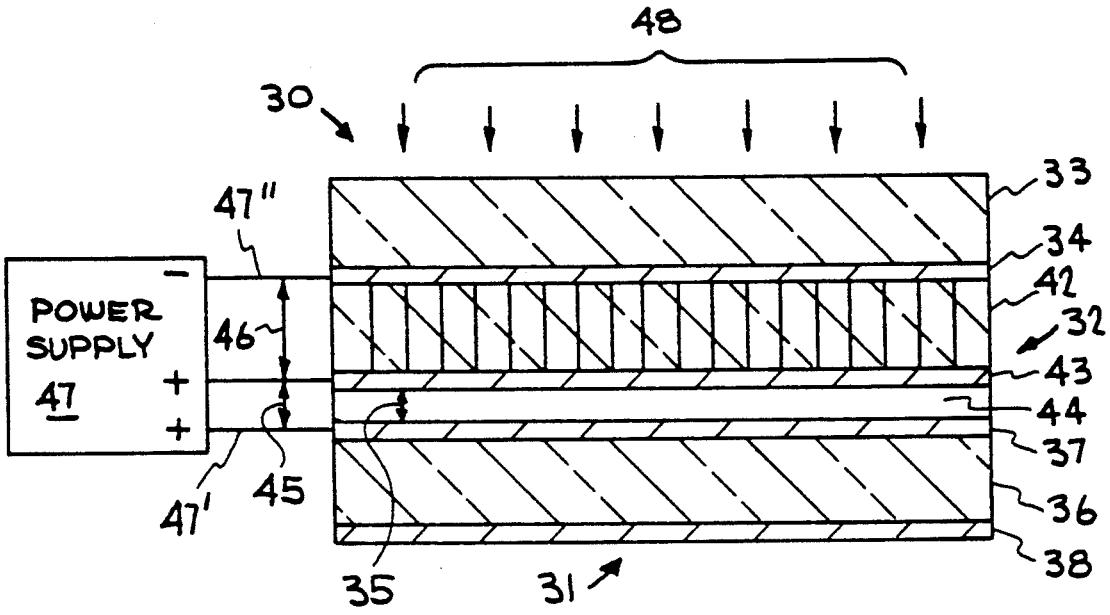
FIG. 4 is a cross-sectional view of an embodiment of the photocathode buffer for a gamma-insensitive optical sensor.
Figure 5:
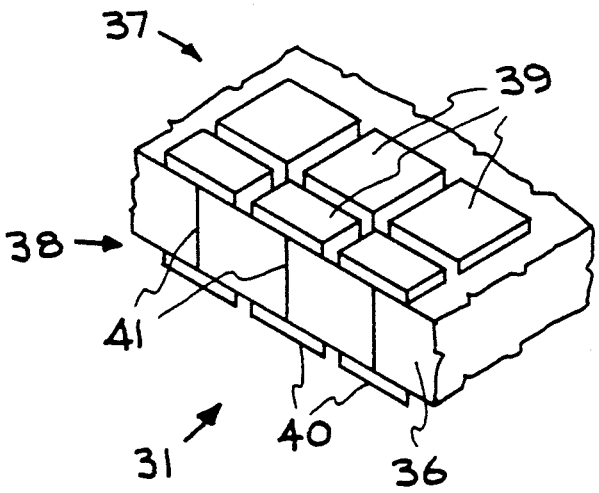
FIG. 5 is an enlarged partial view similar to FIG. 2, of the anode of the FIG. 4 embodiment.

Referring now to FIGS. 4 and 5 which illustrates an embodiment of the gamma-insensitive optical sensor utilizing a buffer assembly in accordance with the present invention, this embodiment utilizes the components of the sensor of FIGS. 1-3 and in this embodiment includes a glass honeycomb/thin (1000 Å) film buffer assembly positioned intermediate the photocathode and the avalanche gas. The FIG. 4 embodiment basically comprises a cathode generally indicated at 30, an anode generally indicated at 31 and a buffer assembly generally indicated at 32.

The cathode 30 comprises a base or support plate 33 having a layer 34 of material secured thereto and referred to hereinafter and illustrated as a photocathode. The cathode plate 33 is constructed in this embodiment of 1 mm thick monolithic quartz, but may be made of any other material transparent at the wavelength of the optical photons to be detected, or constructed of transparent fibers, such as 1 mm (1000μ) length, 30μ diameter quartz fibers. The photocathode 34 is constructed of a thin layer of a semi-transparent material which will convert photons to be detected into electrons which are ejected into the a gap 35 between the cathode 30 and anode 31. The type of material of the photocathode 34 and its thickness are chosen to optimize the efficiency of this conversion process for the photon wavelength to be detected. For ultra-violet, visible, and near-infrared photons the best currently available photocathode materials are those commercially deposited by manufacturers of photomultiplier tubes.

The anode 31 comprises an anode plate 36 having on one side, referred to herein as the front side, an anode pad matrix or array of a desired pattern generally indicated at 37, and on the opposite side, referred to herein as the back side, a contact pad matrix or array of a matching pattern generally indicated at 38. As shown in detail in FIG. 5, the matrix or array 37 comprises a multiplicity of individual pads 39 constructed to be transparent to certain energies and the matrix or array 38 comprises a multiplicity of individual pads 40 constructed to be reflecting contact pads. Matching pairs of transparent pads 39 of array 37 and the reflecting contact pads 40 of array 38 are electrically interconnected by feed-through wires 41, such as 10μ diameter wires constructed of Invar or any other suitable electric conductive material. The anode plate 36 in the FIGS. 4 and 5 embodiment is constructed of monolithic quartz, but may be composed of a multiplicity of quartz fibers with feed-through wires extending between the fibers for connecting anode pads 39 to contact pads 40, similar to the FIG. 3 arrangement; or may be constructed of scintillating glass or plastic fibers, the fibers having a length of 1000μ and width of 30μ, for example.

By way of example, the cathode and anode plates, 33 and 36, and the anode pad matrix and contact pad matrix, 37 and 38, may be constructed to have the same configuration, thicknesses, and of the same materials, as described above with respect to the FIGS. 1-2 embodiment, with each of the contact pads 40 being provided with contacts, such as indium bumps thereon (not shown) for connection to associated electronics, as previously described. Thus, as in the FIGS. 1-3 embodiments, the sensor may have a 300×300-28μ×28μ pixel pattern, each pixel consisting of an anode pad 39, a contact pad 40, and a feed-through wire 19, with a 4μ space between pixels. As above described, the anode pads 39 are thinned so as to be transparent to Cerenkov light.

The buffer assembly 32 comprises a microchannel plate or honeycomb-like support structure 42 of 1 mm glass honeycomb, for example, and a barrier film 43 of 1000 Å aluminum (Al) or beryllium (Be), for example. The honeycomb-like structure or plate 42 is supported by, secured to, the cathode plate 33 and in contact with the photocathode 34. The glass honeycomb plate or support 42 consists of a uniform distribution of circular pores manufactured, for example, with pore diameters as small as about 12μ with pore center-to-center spacings of up to about 15μ. However, any other combination of pore diameter, pore center-to-center spacing and honeycomb support thickness is acceptable that results in an adequate uniformity of the membrane-to-anode gap as described below. The barrier film 43 is secured to and supported by the honeycomb plate 42 and is spaced from the anode pad matrix 37 by gap or region 35 having a width of 100μ, for example, and filled with an avalanche gas 44, such as methane ($CH_2$).

The barrier film or membrane 43 must meet two requirements: 1) It has to support the pressure differential between the vacuum and the avalanche chamber or gap while maintaining a gap with the anode that is uniform to about ±4% in order for the gain to be uniform across the membrane to about a factor of two, and 2). It must be transparent to the photoelectrons for accelerating potentials which can be stood off within the relatively narrow spaces of the sensor.

As in the FIG. 1 embodiment, a voltage is applied between the anode 31 and cathode 30 to produce an electric field in the gas 44 within gap 35. However, in view of the buffer assembly 32 being located between the cathode and the anode a voltage lower than that applied across the gap 35 is applied across the buffer assembly. For example, a voltage of about 600 volts is applied across the gap 35 as indicated at 45 while a voltage of about 4-6 kV is applied across the buffer assembly 32 as indicated at 46. The applied voltages are provided by an appropriate power supply indicated generally at 47 via appropriate electrical connections indicated at 47' and 47''. The gas 44 in addition to being composed of $CH_4$ may be argon/methane mixture with 90% Ar/10% $CH_4$, for example, or of gases such as xenon, helium, or air, or mixtures thereof, and maintained at a desired pressure of about 150-200 torr, for example, and the buffer assembly 32 is under vacuum, conditions, exemplified as being 150 torr, for example.

When optical (ultra-violet/visible/infrared) photons, indicated by arrow 48 in FIG. 4 are incident on the cathode 30 electrons ejected from the photocathode 34 are accelerated towards the anode 31 through buffer assembly 32 and through the gas 44 of gap 35 by collisions with the molecules of gas, as described above with respect to FIGS. 1-3 embodiment, and charge pulses are collected on anode pads 39 of anode 31. The charge pulses thus collected on the anode pads 39 pass via feed-through wires 41 to contact pads 38 and to appropriate signal electronics as in the FIGS. 1-3 embodiments. Spatial resolution is inherently limited by the diameter of the head of an electron avalanche when it arrives at an anode pad 39 of the anode array or matrix 37, and it has been experimentally established that for a 100μ gap 35, the diameter of the avalanche head when it arrives at the anode pad 17 will be about 10 microns.

The deflection of the barrier film or membrane 43 and the maximum stress in it as a function of the pore radius for aluminum or beryllium films with thickness of 0.05, 0.1, or 0.2μ have been calculated using standard engineering formulas. For example, with a circular film with a fixed outer edge, the maximum deflection ($d_m$) of film (occurring at the center of the film) is:

$$d_{max} = \frac{3}{16} \quad \frac{p(m^2 - 1)a^4}{E\, m^2\, t^3}$$

and the maximum stress (occurring on the edge of the film) is:

$$\sigma = \frac{3}{4} p \left(\frac{a}{t}\right)^2$$

where: p=pressure acting on the film, E=Young's modulus, m=inverse of Poisson's ratio, v, and t=film thickness.

Using handbook values for E, v and the yield strength for Al and Be, the following table was prepared for a plate thicker than the barrier film 43 of the buffer assembly 32:

| Film Material | E (psi) | v | Yield Strength* (Kpsi) |
|---|---|---|---|
| Al | $10 \times 10^6$ | 0.33 | 5–10 |
| Be | $42 \times 10^6$ | 0.025 | 35–45 |

The above yield strength is that of thick plates, and the strength of thin films is larger.

For the pressure loading, the largest operating pressure contemplated for the gamma-insensitive sensor was used, i.e. about 200 torr or 4 psi. This pressure is needed to operate the sensor with a 100μ gap 35 providing an 10μ avalanche head diameter. Actually, gaps several times larger should give avalanche heads sufficiently small for 30μ pixel sizes. The gas pressures for the larger gaps would be lower by a corresponding factor.

Figure 6:
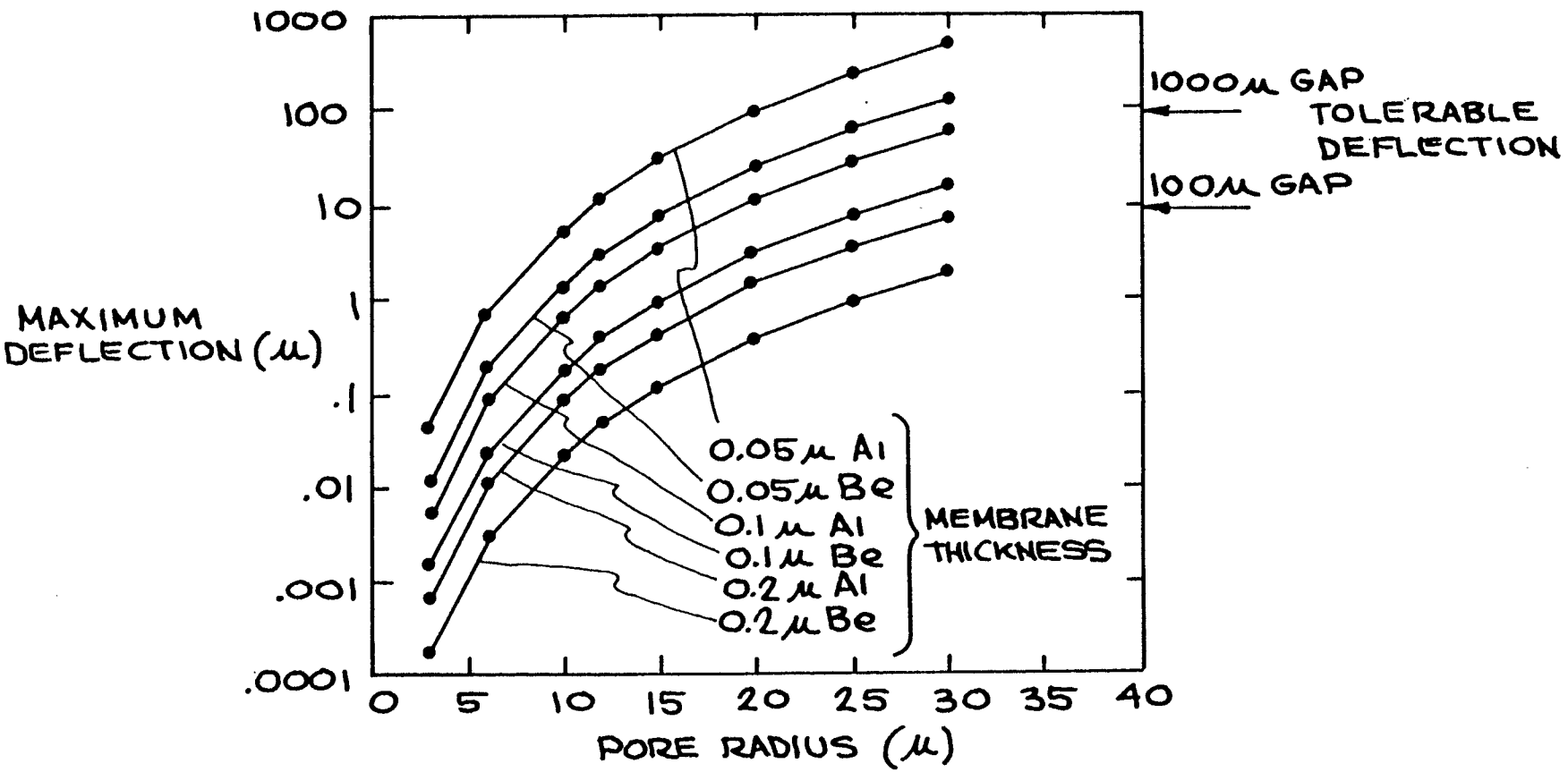
FIG. 6 is a graph illustrating the buffer barrier membrane deflection at 4 Psi gas pressure.
Figure 7:
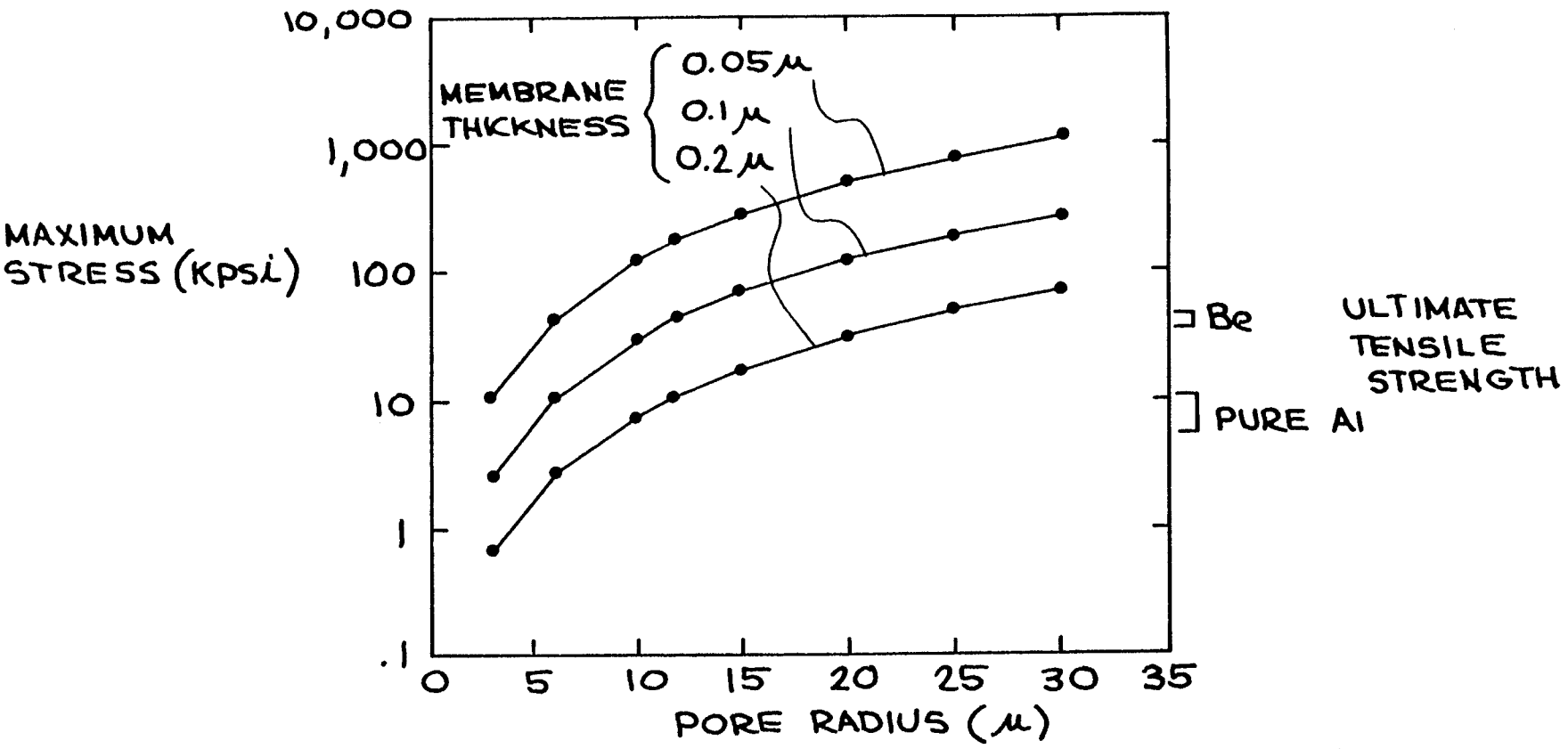
FIG. 7 is a graph illustrating the buffer barrier membrane stress at 4 Psi gas pressure.

The results of the calculations are plotted in FIGS. 6 and 7. It can be seen from these figures that the maximum tolerable pore radius is determined by the yield strength of the film 43 rather than the maximum tolerable deflection. For example, a 0.1μ (1,000 Å) aluminum film requires a pore radius <6μ while such a beryllium film can operate with a pore radius as large as about 12μ. For a 6μ pore radius the beryllium film can be as thin as about 500 Å. The deflections under these conditions are all negligible (<1μ). Thus, as shown in FIGS. 6 and 7, the thickness of barrier film 43 may vary from about 0.05μ to about 0.2μ.

Based on a graph showing various measurements of the penetration depth of electrons, found in R. Kollath, Handbuck der Physik, Vol. XXI, 1956, the accelerating voltage between the photocathode 34 and the barrier film 43 must be in excess of 3 kV for a 1,000 Å thickness of aluminum. For a 1,000 Å beryllium film, the voltage can be less because the density of beryllium is only 1.8 g/cc compared to 2.7 g/cc for aluminum.

The maximum deflection and stress for the quartz cathode plate 33 which supports the glass honeycomb structure 42 has been computed. When the sensor operates in space, the plate 33 is loaded from the inside by the avalanche gas pressure which would at most be 4 psi. When the sensor is tested in the ground-based laboratory, the plate 33 would see a net external load which could be as large as one atmosphere or about 15 psi.

The formulas for the quartz plate 33, treated as a circular plate with a supported (but not fixed) outer edge are a little different than those used for the barrier film 43. The maximum deflection is $$d_{max} = \frac{3}{16} \frac{p(m-1)(5m+1)a^4}{E\,m^2}$$

and the maximum stress is $$\sigma = \frac{3}{8} p \frac{(3m+1)}{m} \left(\frac{a}{t}\right)^2$$

Both these maximum values occur at the center of the plate. Using $E=10.5\times10^6$ psi, v=0.16, t=0.1 cm, a=0.5 cm, and a pressure of 15 psi, we obtain $d_{max}=0.7\mu$ and s=440 psi. The deflection is quite tolerable and the stress is negligible compared to the ~7,000 psi tensile strength of fused quartz.

While the buffer assembly 32 functions to prevent any chemical incompatibility between the material of the photocathode 34 and the composition of the gas 44, an additional benefit of the barrier film 43 is that it will protect the photocathode 34 from ion and photon feedback. Thus, the present invention provides a gamma-insensitive optical sensor which may be utilized with a variety of materials forming the photocathode and a variety of avalanche gas compositions without concern for chemical incompatibility between the photocathode and the gas. Therefore, the present invention enables the sensor described and claimed in the above-referenced parent application to be utilized without limitations due to the chemical compatibility issue.

While the buffer assembly has been described as including a glass honeycomb-like support structure or section 42 and an Al or Be barrier film 43, other insulating materials capable of supporting the membrane may be used in the honeycomb in place of glass, and the barrier film may also be constructed from other conductive materials which can be produced as a thin film or from non-conductive materials coated with a conductive material, as long as the honeycomb and the barrier film materials do not interfere with the generation of an electron avalanche created by a selected photon causing an electron to be ejected from photocathode, as described above.

While a particular embodiment of the invention has been illustrated and described, and specific materials, configurations, characteristics, etc., have been described such is not intended to limit the invention. Modifications and changes will become apparent to those skilled in the art. It is intended to cover in the scope of this invention that described and/or illustrated, as well as modifications and changes, and any limitation on the scope of this invention is based on the scope of the appended claims.

I claim:

1. In a gamma-insensitive sensor comprising a cathode and an anode separated by a gap containing a gas and means for applying an electric potential between the anode and the cathode thereby producing an electric field in the gap, the improvement comprising:

a buffer assembly positioned intermediate said cathode and said anode for preventing chemical incompatibility between materials constituting the cathode and the composition of the gas within the gap.

2. The improvement of claim 1, wherein said buffer assembly comprises a honeycomb-like support structure, and a barrier film of material transparent to electrons passing from the cathode to the anode.

3. The improvement of claim 2, wherein said honeycomb-like support structure is under a vacuum.

4. The improvement of claim 2, wherein said honeycomb-like support structure is constructed from any insulating material providing adequate support to the barrier film, so as to provide acceptable barrier film-to-anode gap uniformity.

5. The improvement of claim 4, wherein said honeycomb-like support structure is constructed of glass with a uniform distribution of circular pores having diameters of greater than 12μ and pore center-to-center spacings of greater than 15μ, and has a thickness in the range of 0.5 mm to 2 mm.

6. The improvement of claim 5, wherein said pore diameters are in the range of 12μ to 30μ, and wherein said pore center-to-center spacings are in the range of 15μ to 40μ.

7. The improvement of claim 2, wherein said barrier film is constructed from conducting material that can be produced as a thin film.

8. The improvement of claim 7, wherein said barrier film has a thickness of 0.05μ to 0.2μ.

9. The improvement of claim 7, wherein said barrier film is constructed from the group of aluminum and beryllium and has a thickness of 1000 Å.

10. The improvement of claim 1, additionally including means for applying a voltage across said honeycomb-like structure.

11. A gamma-insensitive sensor comprising:

a cathode;

an anode;

said cathode and said anode being separated to form a gap there between;

a buffer assembly positioned between said cathode and said anode and located adjacent said cathode;

said anode including a plurality of anode pads defining a pattern;

said gap containing a gas;

means for applying an electric potential between the anode and the cathode for producing an electric field there between; and means for detecting electron avalanche charges on said anode pads.

12. The sensor of claim 11, wherein said buffer assembly prevents chemical incompatibility between materials of said cathode and composition of said gas, and comprises a honeycomb-like structure and a barrier membrane transparent to electrons passing from the cathode to the anode pads.

13. The sensor of claim 12, wherein said honeycomb-like structure of said buffer assembly is under a vacuum.

14. The sensor of claim 12, wherein said honeycomb-like structure is constructed of material selected from the group consisting of glass, and other insulating material.

15. The sensor of claim 14, wherein said barrier membrane is constructed of material selected from the group consisting of aluminum, beryllium, and other conducting material or non-conducting material coated with a conducting material.

16. The sensor of claim 15, wherein said barrier membrane has a thickness of about 0.05μ to about 0.2μ.

17. The sensor of claim 16, wherein said honeycomb-like structure has pore sizes of about 12μ to about 30μ, pore center-to-center spacings of about 15μ to about 40μ, and a thickness of about 0.5 mm to about 2 mm.

18. The sensor of claim 17, wherein said honeycomb-like structure is constructed of glass, wherein said barrier membrane is constructed from aluminum or beryllium, and wherein said honeycomb-like structure is under a vacuum.

19. The sensor of claim 18, wherein said honeycomb-like structure has a thickness of about 1 mm, wherein said barrier membrane has a thickness of about 1000 Å, and wherein said vacuum in said honeycomb-like structure is about 150–200 torr.

20. An optical focal plane array, comprising:

a planar monolithic quartz cathode plate;

a semi-transparent photocathode layer disposed over a planar surface of the quartz plate;

a planar monolithic anode plate, positioned parallel to the photocathode layer and separated therefrom by a narrow gap, with a first planar surface of the anode plate being closer to the photocathode layer than a second planar surface of the anode plate;

a pixel array of anode pads disposed upon the first planar surface of the anode plate;

a pixel array of contact pads disposed upon the second planar surface of the anode plate;

means for electrically connecting each anode pad to a corresponding contact pad;

a gas positioned within the narrow gap;

a buffer assembly positioned between said photocathode layer and said gas to prevent chemical incompatibility there between; and means for impressing a voltage between the anode pads and the photocathode layer.

* * * * *